United States Patent [19]

Welzel et al.

[11] Patent Number: 4,869,182

[45] Date of Patent: Sep. 26, 1989

[54] PROCESS AND DEVICE FOR THE BONDING OF SALT-FORMING AGENTS TO SOLIDS DURING THE COMBUSTION OF FOSSIL FUELS, WASTE

[75] Inventors: Horst Welzel, Werne; Otto Faatz, Wolfsburg, both of Fed. Rep. of Germany

[73] Assignee: EVS Energie-Versorgungssysteme GmbH, Cologne, Fed. Rep. of Germany

[21] Appl. No.: 196,716

[22] Filed: May 20, 1988

[30] Foreign Application Priority Data

May 22, 1987 [DE] Fed. Rep. of Germany ..... 3717191
Mar. 15, 1988 [DE] Fed. Rep. of Germany ..... 3808485

[51] Int. Cl.[4] ..... F23G 5/00

[52] U.S. Cl. ..... 110/346; 110/162; 110/242; 110/342

[58] Field of Search ..... 110/342, 343, 344, 346, 110/162, 242

[56] References Cited

U.S. PATENT DOCUMENTS 4,465,000 8/1984 Shimoda ..... 110/343
4,487,137 12/1984 Horvat et al. ..... 110/162 X
4,546,711 10/1985 Kerwin ..... 110/342 X
4,624,192 11/1986 Mansfield ..... 110/344

FOREIGN PATENT DOCUMENTS 3329823 1/1987 Fed. Rep. of Germany .

*Primary Examiner*—Edward G. Favors
*Attorney, Agent, or Firm*—Foley & Lardner, Schwartz, Jeffery, Schwaab, Mack, Blumenthal & Evans

[57] ABSTRACT

Virtually complete bonding of salt-forming agents to solids during the combustion of fossil fuels, waste or the like by adding basic solids, in particular $CaCO_3$ or $MgCO_3$, can be achieved by the following process steps:

the moisture content of the fossil fuels, the waste or the like is adjusted to 10 to 35% by weight;

the basic substances are added to the fossil fuels, the waste or the like in the most uniform distribution possible, the stoichiometric ratio of basic substances to salt-forming agents being less than 5:1;

after the basic substances have been added, the fossil fuels, waste or the like remain in an essentially sealed container, so that a state of water vapor saturation is obtained;

the mixture is then burnt at a fuel bed temperature below the thermal dissociation temperature of the compounds resulting from the basic substances and the halogens.

32 Claims, 1 Drawing Sheet

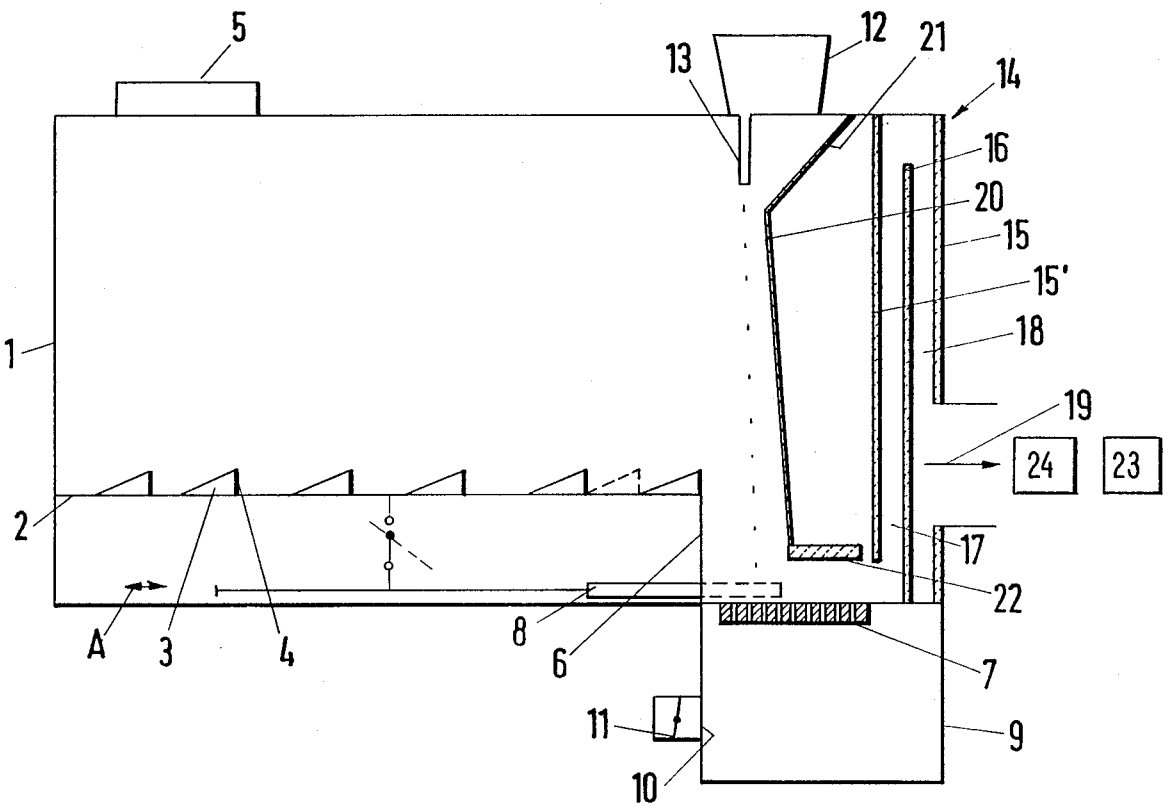
1
2
3
4
5
6
7
8
9
10
11
12
13
14
15
15'
16
17
18
19
20
21
22
23
24
A

PROCESS AND DEVICE FOR THE BONDING OF SALT-FORMING AGENTS TO SOLIDS DURING THE COMBUSTION OF FOSSIL FUELS, WASTE

BACKGROUND OF THE INVENTION

The present invention relates to a process and a device for the bonding of salt-forming agents to solids during the combustion of fossil fuels, waste or the like, in which process basic substances, in particular $CaCO_3$ or $MgCO_3$, are added to the waste prior to combustion.

It is known that the formation of acid gases during the combustion of waste or fossil fuels can be counteracted by the addition of basic solids. Thus, it is known to admix basic solids in the form of calcium carbonate ($CaCO_3$) or magnesium carbonate ($MgCO_3$) to the dry waste and to form the mixture into briquettes. Combustion of the briquettes is then carried out at relatively high temperatures.

Furthermore, it is known to blow pulverulent basic solids into the combustion chamber (fluidized-bed furnace). In both cases, the purpose of adding the basic solids is to neutralize the acids formed during combustion. Some of the salt-forming agents which are chemically converted by the basic solids, in particular in the form of halogens, are present in the slag in a non-hazardous form after the combustion process.

Results achieved with known processes lead to only a relatively slight reduction in the discharge of acid gases, so that subsequent flue gas scrubbing is regularly required if acid gases are not to be blown into the atmosphere.

SUMMARY OF THE INVENTION

It is therefore an object of the invention to provide a process for the combustion of fossil fuels, waste and the like in which virtually no acid gases are produced from the salt-forming agents during the combustion, so that subsequent flue gas scrubbing can eliminated.

These and other objects are achieved by a process for the bonding of salt-forming agents to solids during the combustion of fossil fuels, waste or the like, comprising the steps of: adjusting the moisture content of the fossil fuels, waste or the like to 10 to 35% by weight; adding basic substances to the fossil fuels, waste or the like in an even distribution, the stoichiometric ratio of basic substances to the salt-forming agents being less than 5:1; creating a state of water vapor saturation in an essentially sealed container; burning the mixture at a fuel bed temperature below the temperature for thermal dissociation of the compounds formed from the basic substances and the salt-forming agents.

Other objects, features and advantages of the present invention will become apparent from the following detailed description. It should be understood, however, that the detailed description and the specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The single figure of drawing shows a schematic illustration of a device for carrying out the process according to the invention.

DETAILED DESCRIPTION OF THE PREFERRED EMBODIMENTS

The process according to the invention includes the following process steps:

the moisture content of the fossil fuels, waste or the like is adjusted to about 10 to 35% by weight;

the basic substances are added to the fossil fuels, waste or the like in the most even distribution possible, the stoichiometric ratio of basic substances to the salt-forming agents being less than about 5:1;

after the basic substances have been added, the fossil fuels, waste or the like remain in an essentially sealed container so that a state of water vapor saturation is obtained;

the mixture is then burnt at a fuel bed temperature below the temperature for thermal dissociation of the new compounds formed from the basic substances and the salt-forming agents.

The process according to the invention achieves a virtually one hundred percent conversion of the salt-forming agents even upstream of the fuel bed to give non-hazardous compounds having a high thermal stability, i.e. a high thermal dissociation temperature. The process enables virtually complete retention of the new compounds in the slag if the combustion temperature is adjusted such that the fuel bed temperature is below this dissociation temperature. If calcium carbonate or magnesium carbonate is used, the thermal dissociation temperature of customary salt-forming agents contained in the waste (mostly halogens) is about 850° C. or above, so that without previous testing of the waste, a fuel bed temperature of below about 850° C., preferably below about 810° C., is set. The temperature in the combustion chamber which is effective for waste combustion is potentially much higher in this process, so that effective waste combustion is achieved even when the fuel bed temperature is adjusted to below about 850° C.

The stoichiometric ratio between the basic substances and the salt-forming agents is preferably less than about 4.2:1, in particular approximately about 2:1. However, the stoichiometric ratio depends on the form of addition of the basic substances, i.e., on the fine distribution of the basic substances achieved within the fossil fuels, waste or the like. A very fine distribution i.e. an intimate mixture of basic substances with the fossil fuels, waste or the like is achieved by, for example, spraying on the basic substances.

By adjusting the moisture content of the fossil fuels or waste (the moisture content indicated not being related to water of crystallization or chemically bonded water) and by establishing a state of water vapor saturation during the residence time, virtually complete reaction of the basic substances with the salt-forming agents, in particular with halogens, in the fossil fuels or waste is achieved. As the reactions proceed exothermically, the temperature is considerably increased. This results in vigorous evaporation, resulting in drying of the fossil fuels, waste or the like, so that they can be burnt easily in the fuel bed.

Preferably, the residence time in the closed container between the addition of the solids and the fuel bed is at least about 10, and preferably at least about 20, minutes. In a continuous process, the residence time may result advantageously from the transport of the fossil fuels, waste or the like from the feed station for the basic substances to the fuel bed. In each case, water vapor saturation should occur at not less than about 40° C. in order to obtain good reaction conditions.

When calcium carbonate or magnesium carbonate is added, the compounds formed with the salt-forming agents are, for example, $CaCl_2$, $CaSO_4$, $Ca(NO_3)_2$ or $MgCl_2$, $MgSO_4$ an $Mg(NO_3)_2$. These substances have high thermal dissociation temperatures which are not reached when the fuel bed temperature is kept below about 850° C., so that these substances remain in the slag and the use of this slag as a building material, e.g. for road construction, is absolutely safe.

The basic substances can preferably be added as a suspension or a solution of basic solids. In this case, the moisture content of the fossil fuels, waste or the like is preferably adjusted to about 25% by volume.

If the basic substances are added in a feeder station arranged upstream of the fuel bed, and the former is bounded by a side wall having a large radiant-heat area which is heated by the combustion gases of the fuel bed, a temperature which is advantageous for the conversion of the salt-forming substances to non-hazardous solids having high dissociation temperatures can be set prior to combustion in the fuel bed, without it being necessary to carry out additional heating operations for this purpose. The temperature set at the feeder station is about 180°-300° C., preferably about 300° C.

Good regulation of the low fuel bed temperature can be achieved by establishing a vacuum above the fuel bed by pumping off gas. The vacuum can preferably be about 0.3 mbar, it being necessary for the flow rate in the combustion chamber to be less than about 3 m/s.

As a result of the addition according to the invention of the basic substances and the maintenance of a low fuel bed temperature, the occurrence of inorganic acid gases is reduced in the manner described. However, during the combustion of fossil fuels, waste or the like hydrocarbons are also regularly formed. It is known to reduce, or to avoid, pollution of the air with hydrocarbons by post-combustion of the flue gases. For this purpose, the flue gases containing the hydrocarbons are heated to temperatures of more than 1000° C. in an additional burner, over a zone of a size such that the hydrocarbons—and any carbon monoxide which has formed—are converted to carbon dioxide. Such a post-combustion zone is very costly and its energy consumption is high.

According to the invention, it is also possible, in a combined device, to render the hydrocarbons non-hazardous by arranging a post-reaction chamber that receives the combustion gas and whose walls are designed so that the heat losses incurred are low, in a position above the fuel bed. In this arrangement, the walls are formed of an infrared-radiating material, preferably ceramic, with SiC compounds being particularly preferred. The combustion gases automatically cause a temperature of more than about 900° C., in particular a temperature between about 1050° C. and 1250° C., in the post-reaction chamber. By means of by-pass pipes, the radiation intensity of the infrared radiation for the combustion gases in the post-reaction chamber can be intensified so that the hydrocarbon molecules dissociate to give $CO_2$ and $H_2O$ or $CO_2$ and $NO_2$ under the action of the infrared radiation, if the time during which the infrared radiation is allowed to act is longer than 0.1 second. Moreover, gaseous sulfur oxides and nitrogen oxides are processed in the post-reaction chamber so that, in the form of gaseous sulfuric acid and gaseous nitric acid, they can be fed to a condenser where they are removed from the exhaust air in the form of acid condensate, as has been described, for example, in German Patent Specification No. 3,329,823.

The pumping-off of the combustion gases mentioned previously is advantageous for maintaining a uniform high temperature in the post-combustion chamber if a fresh air feed, if appropriate with restricted flow, is arranged below the fuel bed. The effect of this is that no temperature drop is caused by secondary air above the fuel bed in the zone of the combustion gases, as was hitherto the case in secondary air feeds above the fuel bed to increase the fuel bed temperature. The secondary air feed thus does not disturb the post-reaction.

By adjusting the pumping-off of the combustion gases, it is possible to maintain the fuel bed temperature at the desired low level. Furthermore, pumping too much combustion air through the fuel bed can be prevented. Air is not required for combustion and might therefore lower the temperature above the fuel bed. A measure for correct combustion, in particular in the case of part-loading, is the maintenance of a content of free oxygen in the post-reaction chamber of about 3% by volume or less. Thus, it is advantageous to measure the content of free oxygen in the post-reaction chamber and to regulate pumping-off accordingly.

As shown in the single figure of drawing, in an essentially closed casing 1 is feeder belt 2 which moves to and fro horizontally as indicated by double arrow A. On the upper side of feeder belt 2 are driving wedges 3 which rise obliquely in the direction of transport, then fall sharply to give the shape of a sawtooth, and thus form steep edge 4. When conveyor belt 2 moves forward, steep edge 4 pushes fuels which have slid over the slope in the direction of transport, resulting, in the drawing, in a transport to the right, even though conveyor belt 2 only moves to and fro.

Feeding of the fossil fuels is carried out from the upper side of casing 1 via metering device 5, for example a metering screw or a star feeder. At the end of conveyor belt 2, the fossil fuels fall, via step 6, on to a lower level on which grate 7 is arranged. Pushing device 8 is coupled to the movement of conveyor belt 2, and pushes the fossil fuels on grate 7, in the drawing, to the right, where they form the fuel bed. Under grate 7 there is ash box 9, the wall of which has an opening for fresh air feed 10. In the fresh air feed, there is throttle flap 11 for regulating the stream of fresh air. Feeder station 12 for a solution or a suspension of basic solids is arranged in the upper side of casing 1, upstream of grate 7. Feeder station 12 has drip nozzle 13 by means of which the basic substances can be metered in.

Post-reaction chamber 14 which receives the combustion gases is located above grate 7. Post-reaction chamber 14 has ceramic side walls 15 and ceramic separating wall 16, which is arranged so that vertical ascending pipe 17 and vertical counterflow pipe 18 are formed which end in outlet 19 of post-reaction chamber 14. Next to outlet 19 there is a separate heat exchanger 23 of conventional design.

Ceramic outside wall 15', facing feeder station 12 has a large radiant-heat area. The radiant heat from it is absorbed by heat-conducting metal sheet 20 that extends upwardly from below conveyor belt 2, facing obliquely away from grate 7 and arranged immediately next to feeder station 12. As a result of the radiant heat delivered from ceramic outside wall 15', the heat-conducting metal sheet is heated to a temperature which provides a sufficiently high reaction temperature in the zone of feeder station 12. In this zone, approximately 300° C. are preferably obtained, promoting the reaction of the halogens with the added basic substances to give non-hazardous reaction products having high dissociation temperatures.

Upper edge of metal sheet 20, arranged slightly below drip nozzle 13, is continued in a piece of sheet metal 21 sloping obliquely towards outside wall 15, The piece of sheet metal 21 provides openings for condensate liquid, through which openings the condensate liquid cooled in the upper zone of casing 1 is led between metal sheet 20 and outside wall 15, of post-reaction chamber 14 and, through an opening in ceramic tray 22 arranged between sheet 20 and outside wall 15', can drip on to grate 7 so that a circuit is formed.

By suitably adjusting the pumping-off means 24, a low flow rate is maintained for the combustion gases, and the illustrated embodiment of post-reaction chamber 14 provides a sufficiently long residence time of the combustion gases in a high-temperature zone. By this process, the combustion gases are converted in the desired manner.

What is claimed is:

1. A process for the bonding of salt-forming agents to solids during the combustion of fossil fuels, waste or the like, comprising the steps of:

adjusting the moisture content of the fossil fuels, waste or the like to 10 to 35% by weight;

adding basic substances to the fossil fuels, waste or the like in an even distribution, to form a mixture, the stoichiometric ratio of basic substances to the salt-forming agents being less than 5:1;

creating a state of water vapor saturation in an essentially sealed container containing said mixture so that a virtually complete reaction occurs between the basic substances and the salt-forming agents;

burning the mixture at a fuel bed temperature below the temperature for thermal dissociation of the compounds formed from the basic substances and the salt-forming agents.

2. The process as claimed in claim 1, wherein the stoichiometric ratio is chosen so that it is less than about 4.2:1.

3. The process as claimed in claim 1, wherein the stoichiometric ratio is chosen so that it is approximately 2:1.

4. The process as claimed in claim 1, wherein the fuel bed temperature is chosen such that it is less than about 850° C.

5. The process as claimed in claim 1, wherein the residence time in the sealed container between addition of the basic substances and combustion is at least about 10 minutes.

6. The process as claimed in claim 1 wherein the residence occurs during transport of the fossil fuels, waste or the like from the feeder station for the basic substances to the fuel bed.

7. The process as claimed in claim 1, wherein the moisture content is about 25% by volume.

8. The process as claimed in claim 1, wherein the basic substances are added in the form of a suspension or solution of basic solids.

9. The process as claimed in claim 1, wherein the basic substances are added in a feeder station arranged upstream of the fuel bed, which feeder station is bounded by a side wall which has a large radiant-area heated by the combustion gases of the fuel bed.

10. The process as claimed in claim 9, wherein a temperature of the feeder station is about 80° C.–250° C.

11. The process as claimed in claim 10, wherein a temperature of the feeder station is about 300° C.

12. The process as claimed in claim 1, additionally comprising the step of pumping off gas above the fuel bed to establish a vacuum.

13. The process as claimed in claim 12, wherein vacuum is about 0.3 mbar.

14. The process as claimed in claim 1, addition comprising the step of providing a post-reaction chamber above the fuel bed to receive combustion gas, the walls of the chamber being formed such that losses incurred are low.

15. The process as claimed in claim 14, wherein flow rate of the combustion gases in the post-reaction chamber is maintained below about 3 m/s.

16. The process as claimed in claim 14, wherein walls of the post-reaction chamber comprise infrared-radiating material.

17. The process as claimed in claim 16, wherein combustion gas in the post-reaction chamber repeatedly deflected by the material of the wall.

18. The process as claimed in claim 14, wherein temperature in the post-reaction chamber is to greater than about 900° C..

19. The process as claimed in claim 18, wherein temperature in the post-reaction chamber is about 1050°–1250° C.

20. The process as claimed in claim 14, wherein the content of free oxygen in the post-reaction chamber is less than or equal to about 3% by volume.

21. The process as claimed in claim 12, additionally comprising the step of adjusting the combustion parameters by controlling the vacuum or the flow rate of the combustion gases which are pumped off.

22. The process as claimed in claim 14, wherein a heat exchanger is connected to the outlet of the post-reaction chamber.

23. A device for carrying out the process as claimed in claim 1, comprising:

means for feeding fuels to a fuel bed;

a feeder station for basic substances, arranged upstream of the fuel bed;

an essentially leaktight casing encompassing the feeder station and the fuel bed; and a controllable device for pumping off the combustion gases rising from the fuel bed.

24. The device as claimed in claim 23, additionally comprising a fresh air feed beneath the fuel bed.

25. The device as claimed in claim 24, additionally comprising a restrictor in the fresh air feed.

26. The device as claimed in claim 23, additionally comprising a post-reaction chamber having ceramic walls arranged above the fuel bed.

27. The device as claimed in claim 26, additionally comprising, in the post-reaction chamber, a pipe arrangement having one vertical ascending pipe and at least one vertical counter-flow pipe, each bounded by ceramic walls.

28. The device as claimed in claim 26, wherein the ceramic walls consist of SiC compounds.

29. The device as claimed in claim 26, additionally comprising a separate heat exchanger connected to the outlet of the post-reaction chamber.

30. The device as claimed in claim 26, additionally comprising, near to the feeder station, a heat-conducting metal sheet facing obliquely away from the fuel bed which absorbs heat reflected from a ceramic outside wall of the post-reaction chamber.

31. The device as claimed in claim 30, additionally comprising:

a piece of sheet metal obliquely facing the post-reaction chamber and exhibiting openings for the passage of condensation liquid, said piece of sheet metal adjoining the upper edge of the metal sheet; and a tray arranged above the grate, between the underside of the metal sheet and the outside wall of the post-reaction chamber, said tray exhibiting an outlet aperture for the condensate liquid.

32. The device as claimed in claim 23, additionally comprising a drip nozzle in the feeder station for the suspension or solution of the basic substances.

* * * * *